US005445050A

United States Patent [19]

Owens

[11] Patent Number: 5,445,050

[45] Date of Patent: Aug. 29, 1995

[54] HAND-HELD ICE SKATE BLADE SHARPENER TOOL

[76] Inventor: Michael R. Owens, 40 Bobbie Dr., Ivyland, Pa. 18974

[21] Appl. No.: 175,979

[22] Filed: Dec. 30, 1993

[51] Int. Cl.[6] ..... B23F 21/03

[52] U.S. Cl. ..... 76/83; 451/558; 451/392

[58] Field of Search ..... 51/205 WG, 205 R, 214, 51/391, 392, 393; 76/83, 88, 82; 451/558, 557, 523, 524, 525, 555

[56] References Cited

U.S. PATENT DOCUMENTS

| | | | |
|---|---|---|---|
| 73,118 | 1/1868 | Prettyman | 76/83 |
| 300,656 | 6/1884 | St. Pierre | 451/555 |
| 2,398,566 | 4/1946 | Talbert | 76/83 |
| 2,978,930 | 4/1961 | Bratton | 76/83 |
| 3,585,880 | 6/1971 | Kabriel | 76/83 |
| 4,815,240 | 3/1989 | Larson | 51/205 WG |
| 4,908,994 | 3/1990 | Fraser | 451/555 |
| 5,239,785 | 8/1993 | Allen | 76/83 |

FOREIGN PATENT DOCUMENTS

| | | | |
|---|---|---|---|
| 0158902 | 12/1932 | Switzerland | 76/83 |
| 0605743 | 7/1948 | United Kingdom | 51/205 WG |

*Primary Examiner*—Robert A. Rose
*Attorney, Agent, or Firm*—John J. Simkanich

[57] ABSTRACT

A hand-held ice skate blade sharpener tool is provided which includes a configuration for honing, concurrently, the hollow groove and the side walls of an ice skate blade, to dress the edges of the blade in situ, at any convenient time. The tool has a guide to accept the blade's hollow surface and its edges, and to align same with the honing surfaces of the tool. An extruded housing of plastic or like material surrounds the honing surfaces and is of a shape to provide a grasping surface while protecting the hand from the sharp edges of the skate blade. The entire assembly is relatively light weight and relatively small, thereby rendering the device reasonably inexpensive to manufacture. The tool is intended to be disposable.

16 Claims, 2 Drawing Sheets

HAND-HELD ICE SKATE BLADE SHARPENER TOOL

BACKGROUND OF THE INVENTION

The present invention is directed to sharpening tools and in particular hand-held sharpening tools for sharpening ice skate blades.

Typically ice skate blades are sharpened by machining or grinding the blade edges on a milling machine or a grinding machine, respectively. Such machines may either be manually operated or computer operated. Whether manually or computer operated, such machines typically utilize jigs and guides to set the angle, arc and edges of the blades.

When ice skate blades need resharpening, one has had to usually have them resharpened at a sports shop, a skating rink pro shop, knife and scissors sharpening shop or a grinding shop catering to sporting equipment. In such instances the resharpening charges can amount to a considerable amount, and the sharpening job is not necessarily acceptable in quality. Such a sharpening job usually depends upon the care and skill of the operator. Moreover, the skate owner would have to relinquish the skates for a turn around time of up to a week.

It has been the object of the trade to develop a portable, and in particular, a hand-held sharpening tool for sharpening ice skate blades, which the skate owner could use. The problem with such prior art tools has been that they have been expensive to build, awkward to use or unreliable in the angle of the blade edges they produce, somewhat dangerous for an inexperienced user or they have been bulky to carry and not disposable.

Among the prior art is the skate sharpener of Krollius, U.S. Pat. No. 1,273,624. This sharpener has a cylindrical housing member in which a cylindrical honing stone is positioned. The cylindrical housing is grasped by the hand and drawn over the blade. Two guide blocks keep the blade sides in alignment with the honing stone. However, these guide blocks are located a considerable distance from the honing stone thereby permitting lateral movement of the blade with respect to the crown of the honing stone. Moreover, there is no control over the change in shape of the honing stone crown as the tool is used. The honing stone being of considerable bulk is intended to be used repeatedly. Both of these features lead to a degradation of the sharpening quality as the tool is used.

Corkum, U.S. Pat. No. 2,054,495, developed a sharpening tool which is more compact than the Krollius tool. Like Krollius, Corkum's tool uses but one honing stone and like Krollius, Corkum's tool is able to sharpen only the hollow concave surface in the bottom of the blade. The Corkum sharpener has a one piece cylindrical shaped housing holding a cylindrical or other shaped honing stone. Unlike Krollius, the Corkum tool has a separate handle extending away from the honing section of the tool. Like Krollius, the Corkum housing is of stamped steel. Corkum uses a separate steel guide section to align the blade with the honing stone. This guide section abuts the stone thereby eliminating the lateral movement permitted by Krollius, but causing either a scoring of the blade sides if the guide way is too tight or a wobbling of the stone as it is drawn over the skate blade. The Corkum hand grasping surface is elongate and cylindrically-shaped, as is Krollius, thereby being difficult to apply an even pressure over the longitudinal length of the stone/tool honing interface with the skate blade. This either promotes uneven sharpening or allows uneven sharpening to occur.

Nicolet, U.S. Pat. No. 2,118,617, introduced a hand-held skate sharpener with two different and separate sharpening guideways, one for the hollow of the blade and one for the blade side. The configuration of the Nicolet tool is such that the operator must hone the skate hollow in one operation and each of the blade sides in following successive second and third operations. Moreover, Nicolet does not provide a precise guide way for the hollow honing and no guideway whatsoever for blade side honing.

Toms, U.S. Pat. No. 2,900,769, introduced honing stone crown position adjustment to hand-held skate sharpener tools. Toms utilizes a solid rectangular block of aluminum or magnesium to hold a cylindrical or curved honing stone in a cylindrical longitudinal bore and incorporates an adjustment screw to adjust the position of the honing crown as the stone wears. Again, with Toms a reasonably bulky honing stone is incorporated for repeated sharpenings.

Kabriel, U.S. Pat. No. 3,585,880, departed from the art prior to his design by developing a hand-held tool which has a plastic housing. Two flat, rectangular honing stones are oriented orthogonally to one another to operate upon the bottom and one side of a skate blade at the same time. The tool housing has a slot into which a skate blade is inserted and into which the two honing stones extend. Kabriel does not concern himself with sharpening the hollow arc of the blade as did the previous art. He concerns himself only with sharpening/honing the corner or edge where the hollow and edge walls of a blade meet. His tool is able to sharpen only one of the two edges at a time. The blade must then be rotated and drawn through the tool to sharpen the second corner. Moreover, Kabriel's tool housing has a very flat or thin structure which allows a cocking or misalignment of the tool and its carried honing stones with the axis of the skate blade.

Larson, U.S. Pat. No. 4,815,240, shows a hand-held skate sharpener with a rectangular block housing similar to Toms. Like Nicolet, Larson utilizes two separate stones set into two separate guideways to sharpen the hollow and each of the two sides of a skate blade in a three step operation. Unlike Toms, Larson intentionally provides very wide guideways so that the skate blade can be shifted in the guideway to adjust the sharpening angle placed on the skate blade at the discretion of the operator. Larson's tool permits variations in sharpening position and tool usage and is intended for use by an expert operator.

Courchesne, U.S. Pat. No. 5,189,845, shows an extremely bulky, cumbersome and variably adjustable skate sharpening tool. With all of its adjustments, this tool concerns itself only with sharpening the hollow of the blade and provides an adjustment of stone position as did Toms. It is significant to note that it is apparently only Toms and Courchesne who recognize that honing pressure is a significant factor in obtaining a satisfactory sharpening and that even pressure over the length of the blade and laterally over the width of the blade is important.

Ellestad, U.S. Pat. No. 5,197,232, shows an elongate rectangular block housing which holds an arc shaped honing stone. Ellestad shows a screw adjustable guideway width. He has no adjustment on his honing stone position. As his honing stone bulk is substantial, the Ellestad tool is intended for repeated use without consideration to change in honing stone crown shape with use.

What is desirable is to provide an improved hand-held skate blade sharpening tool which is capable of sharpening the hollow of a skate blade and the two sides of the blade in one action.

What is also desirable is to provide an improved hand-held skate blade sharpening tool which is structured for an even application to the surfaces of the skate blade to be sharpened and which is disposable before the sharpening members of the tool deform from use.

SUMMARY OF THE INVENTION

An object of the present invention is to provide a disposable hand-held ice skate blade sharpening tool.

A second object is to provide such a tool where the hollow bottom and both sides of the skate-blade are sharpened evenly and with the same motion.

A further object of the present invention is to provide such a tool where the alignment of the blade surfaces with the sharpening structure is assured and wherein an indicator may be available to tell the operator that the sharpening structure is sufficiently worn to change the intended sharpening angles or "set" of the blade.

These objects are realized in a hand-held ice skate blade sharpener which includes a sharpening structure for dressing (i.e. sharpening) the hollow bottom and both sides of a skate blade in one motion. This structure includes three sharpening surfaces aligned in close proximity. Two of the sharpening surfaces are flat and juxtaposed from one another a distance equal to approximately the width of the blade to be sharpened. The third sharpening structure is positioned between the first two sharpening surfaces, and carries a convex face of a shape to dress the hollow of the blade. This convex face extends orthogonally to the two juxtaposed flat faces.

The sharpening structure is held within a lightweight, flexible housing which includes a blade type operator handle. This handle limits the pressure which can be exerted by the operator and distributes the operator hand pressure along the length of the sharpening structure. A portion of the housing includes a slot which receives the skate blade and into which the sharpening surfaces extend. This slot is of a size and shape to simultaneously align the skate blade with the three sharpening surfaces of the structure. The slot is faced with a low friction surface which may be implemented by the material from which the housing is made or another facing material. This low friction facing helps facilitate the continuous alignment of the skate blade with the sharpening tool structure. It also facilitates the sharpening operation by reducing any binding between the housing slot and the skate blade and reducing or eliminating any scoring of the sides of the skate blade during the sharpening operation.

The walls of the housing surrounding the two juxtaposed sharpening surfaces are sufficiently flexible to move slightly under finger pressure. Thus, the operator can squeeze the sides of the housing to move the two juxtaposed sharpening surfaces slightly towards one another to dress the sides of the skate blade during the finish sharpening stroke(s). This enables a duplication of a normal machine sharpening operation where the three surfaces of the skate blade are worked upon and the sides of the blade are given a final dress stroke(s) to set the final angle of the edges.

The sharpening surfaces of the sharpening structure may include a wear indicator or a wear sensor. Such a wear indicator or sensor will enable the operator to tell when the honing surfaces of the tool have begun to distort and/or are sufficiently worn to indicate a degradation of the sharpening quality of the tool.

DESCRIPTION OF THE DRAWINGS

The features, advantages and operation of the hand-held blade sharpener tool of the present invention will become readily apparent and further understood from a reading of the following detailed description with the accompanying drawings, in which like numerals refer to like elements, and in which.

DETAILED DESCRIPTION OF THE INVENTION

The present invention is a hand-held ice skate blade sharpening tool which can be used to dress the edges of ice skate blades in situ. The edges of ice skate blades of serious skaters, including those in figure competition, racing competition and ice hockey, regardless of level of performance, are of constant consideration. Such serious skaters often have two or more pairs of skates ready for use and have their blades professionally sharpened often. Professional sharpening, which often utilizes machine driven grinding or milling, is often times expensive, time consuming and may result in substantial amounts of metal being removed from the blades over a period of time.

Even though a skater may have two or more pairs of identical skates, the feel of the skate boot and the balance of the blades on the boot ,Dan often vary minutely from pair to pair. Thus, a skater will often have a favorite pair of skates which blades he prefers to have in constant peak condition. The present invention is a tool which intended to meet this need by permitting the operator to hone any small nicks and burrs which occur on the blades through use and to sharpen the blade edges to dress the set of the blades ("set" being the finish angle of the point of the metal at which the plane of the side of the blade and the arc of the hollow of the blade meet).

Figure 1:
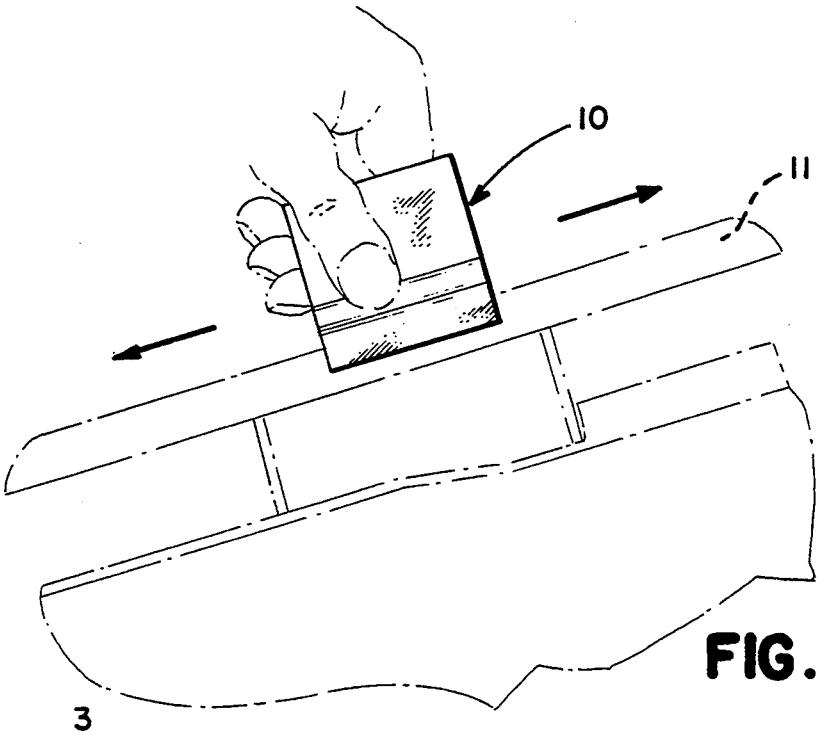
FIG. 1 shows the use of the sharpening tool invention with the operator stroking a skate blade with the tool.

The tool 10, FIG. 1, includes a housing which has a handle portion, a sharpening surface portion and an alignment portion. The tool 10 is operated by inserting it onto the ice skate blade 11 and drawing it back and forth along the length of the blade.

Figure 2:
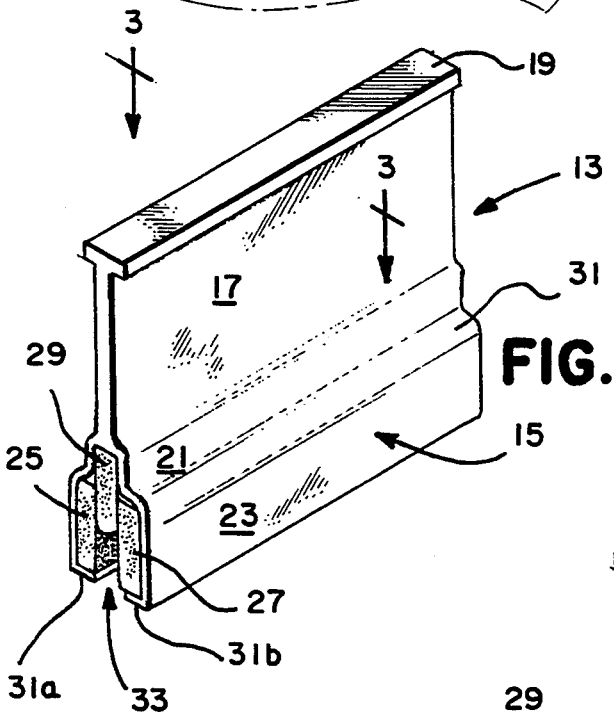
FIG. 2 shows a perspective view of the tool.

The housing 13, is shown in greater detail in FIG. 2. This housing 13 has an elongate base 15 portion and a blade-like handle 17 portion connected to and extending away from the base 15. A small flange is formed into the free edge of the blade handle 17 and extends normal (perpendicular) to the plane of the blade along the length of the free edge.

The housing 13 has an extruded rectangular, tube-like shape, with an open bottom face. This housing incorporates an upper narrower cross-sectional portion 21 adjacent the handle 17, and a wider cross-sectional portion 23 below that portion 21. Both of these housing portions 21, 23, being hollow, hold three elongate rectangular sharpening stones. These stones are first and second respective blade sharpening stones, 25, 27, positioned juxtaposed one another, and a hollow arc sharpening stone 29, positioned between the two juxtaposed side stones 25, 27 and having its face extending orthogonal to the sharpening faces of the side stones 25, 27.

The walls of the narrower housing portion 21 and the wider housing portion 23 are continuous with one another and of a constant thickness, with the wider portion 23 formed by a shouldering out of the narrower portion 21. The walls of the wider portion 23, at the bottom of the housing 13, turn inwardly toward one another to form a pair of facing lips 31*a*, 31*b*. These lips 31*a*, 31*b* are short flanges which position the first and second side stones 25, 27 with respect to the wider portion 23 housing walls.

Figure 3:
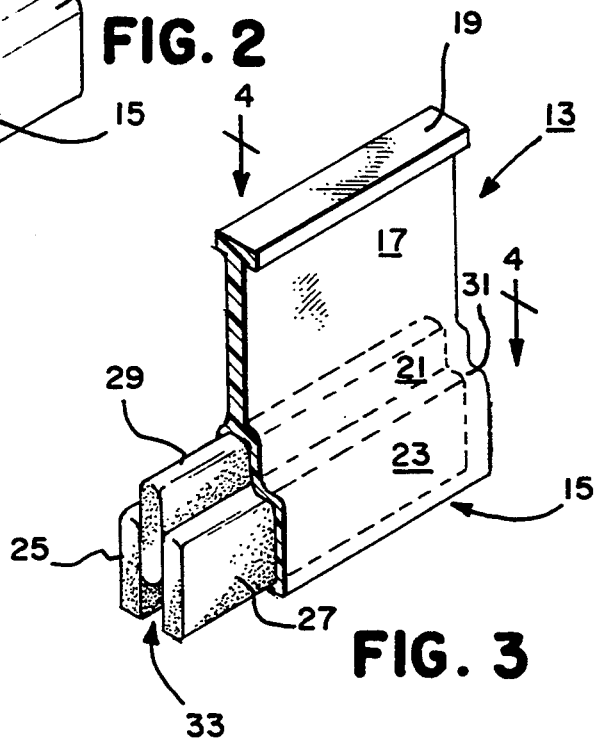
FIG. 3 shows a partial exploded view of the sharpening stones with a partial cut away view of the housing of the tool of FIG. 2, taken as indicated in that figure.

The three sharpening stones 25, 27, 29 are positioned to abut one another, FIG. 3. The faces of the two juxtaposed stones 25, 27 are flat and are used to hone both sides of a blade in one stroke. The hollow honing stone 29 is positioned between the two side honing stones 25, 27 and, offset upwardly from the position of lip flanges 31*a*, 31*b* against which the side honing stones 25, 27 are positioned. This offset creates a guide slot 33 into which the blade 11 is inserted. The width of this slot 33 is established by the width of the hollow honing stone 29. The face of the hollow honing stone 29 is convexly arched to the arc of the blade hollow.

Figure 4:
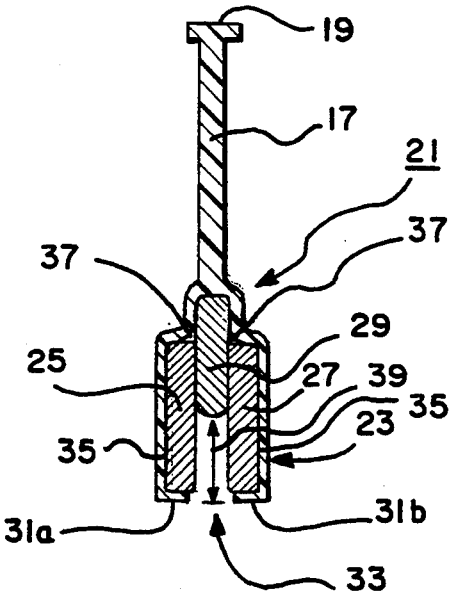
FIG. 4 is a cross sectional end view of the tool of FIG. 2, taken as indicated in FIG. 3.

The assembled configuration of the tool 10 is grasped from the cross-sectional view FIG. 4. The side honing stones 25, 27 are each glued or otherwise fastened to their respective wider portion 23 housing walls with a drop 35 of glue at one or more points. Likewise, the hollow honing stone 29 is glued 37 to one or more points on the narrower portion 21 housing walls. This permits the side honing stones 25, 27 to be moved slightly inwardly towards one another with pressure on the housing walls and to give slightly outwardly with the insertion of the blade 11.

As ice skate blades will vary in width and hollow arc between figure skates, racing skates and hockey skates, the tool 10 of the invention is assembled into custom configurations for the specific blade. This is accomplished by modifying the width and arc of the face of the hollow honing stone 29. The width of the side honing stones 25, 27 can be varied to adjust for wider and narrower hollow honing stones 29, thereby keeping the housing 13 width constant. In the alternative, where constant width side honing stones 25, 27 are used for the various custom configurations, the width of the housing 13 is varied to accommodate the various overall widths of the stone 25, 27, 29 assembly.

The tool 10 is approximately 2 inches long with the blade handle 17 extending a height dimension chosen in the range of from 1 and $\frac{1}{4}$ inches to 2 inches. The wall of the blade handle 17 is approximately $\frac{1}{8}$ inches thick, as the approximate thickness of the handle flange 19, this flange 19 being approximately $\frac{1}{4}$ inches wide. Further, the walls of the narrower and wider housing portions 21, 23 are each approximately 1/16 inches thick, and the distance of inward extension (width) of the lip flanges 31*a*, 31*b* each being about $\frac{1}{8}$ inches.

For sharpening hockey blades, the side honing stones 25, 27 are each $\frac{1}{8}$ inches wide, $\frac{1}{2}$ inches high and 1.25 inches long. The offset 39 distance, FIG. 4, is approximately $\frac{1}{8}$ inches.

Of the two most common skate blades, hockey blades and figure blades, hockey skate blades are often 0.105 inches thick, plus or minus 0.005 inches, and figure skate blades are often 0.145 inches thick, plus or minus 0.005 inches. The width of the hollow honing stone 29 is therefore dependent upon use and approximately the width of the blade to be sharpened, plus 0.001 inches, minus zero.

The stones 25, 27, 29 are each of the same quality and grit specification. They can be obtained from many commercial sources including Norton Company of Worcester, Massachusetts. These stones 25, 27, 29 can be specified as Grade 37C150-KV "finish stick" fine grind stone.

The housing 13, including its component parts 15, 17, 19, 21, 23, 31*a*, 31*b*, is made from a one piece extruded or molded pliable material, such as plastic including soft PVC. The wall thicknesses specified above can be varied with the physical properties of the plastic material chosen. It is desired that the sides of the housing move under finger pressure and that they give slightly when the blade is inserted. It is also desired that the handle 17 distorts under excessive operator hand pressure.

The blade shape of the handle 17 forces the operator to grasp only the upper portions of the handle 17. The handle 17 base is connected to the entire length of the base 15 of the tool 10. Thus any downward force and any longitudinal force applied to the handle 17 is distributed evenly to the base 15 which contains the stones 25, 27, 29. Moreover, any lateral force applied to the blade will tend to bend the blade 17 wall and thereby reduce the effect or eliminate the effect of that lateral force at the base 15. This promotes even honing and reduces the possibility of uneven honing pressures which lead to incorrect sharpening.

Figure 5:
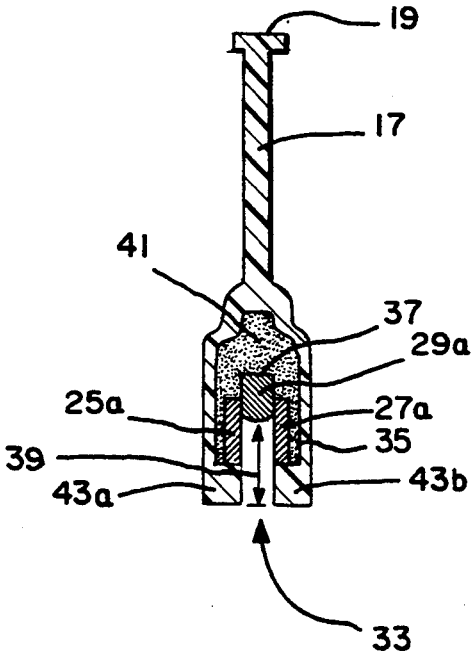
FIG. 5 is an end view of a first alternate embodiment of the tool of FIG. 4 which includes an elongated housing to provide a deeper guide slot with housing material faced guide slot section and with smaller honing stones set in a filler material.

FIG. 5 shows an end view of a first alternate embodiment of the tool 10. For this embodiment, each of the honing stones is made smaller and thinner, while still presenting the same sharpening surface to the skate blade. To make up for the void created by the smaller stones 25*a*, 27*a*, 29*a*, a filler material 41 is inserted between the back of the stones 25*a*, 27*a*, 29*a* and the inside walls of the housing base 15. This filler material can be closed or open cell foam or other easily formable or injectable material which presents a fairly rigid bonding surface to the stone.

The lip flanges 31*a*, 31*b* of FIG. 4 are replaced by guide blocks 43*a*, 43*b*. These guide blocks can be between 1/16 inches to ¼ inches high, thereby providing a guide and alignment slot length of that dimension at the entrance to the blade slot 33. The width of the guide blocks 43*a*, 43*b* is such that they protrude into the slot up to 0.001 inches (the side stone 25*a*, 27*a* faces are undercut about 0.001 inches with respect to the juxtaposed faces of the guide blocks 43*a*, 43*b*). The side stones 25*a*, 27*a* are each free to move with respect to the respective guide blocks 43*a*, 43*b* thereby allowing the side stone 25*a*, 25*b* surfaces to contact the sides of a skate blade 11 when the walls of the base 15 are moved inwardly under finger pressure.

Figure 6:
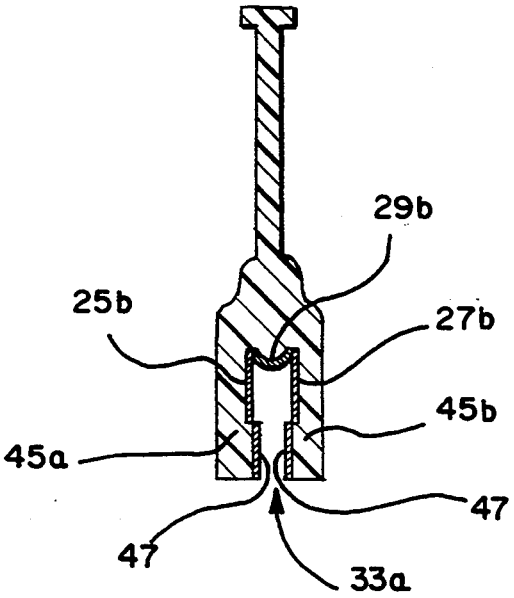
FIG. 6 is an end view of a second alternate embodiment of the tool of FIG. 4 which includes a housing molded to the contours of the three sharpening surfaces with each housing sharpening surface portion faced with a honing film or sheet member and the entry section of the guide slot being undercut and faced with a friction reducing insert sheet.

A second alternate embodiment, FIG. 6, substitutes the PVC or other plastic material, from which the housing 13 base is molded or extruded, for the filler material 41 of FIG. 5. Further, the sharpening stones 25*a*, 27*a*, 29*a* are replaced by a thin film of grit or stone paper. This paper is applied to the molded walls of the base which contain the skate blade slot 33*a*. The base material is shaped and sized to provide the sharpening surfaces for the two blade sides and the convex hollow when faced with the stone impregnated paper sections 25*b*, 27*b*, 29*b*, respectively. These stone paper sections are of the same length as their respective honing stones being replaced. Again, the width of the side honing paper sections 25*b*, 27*b* is equivalent to the width of the respective stones 25*a*, 27*a* of FIG. 5. The same size considerations are carried to paper section 29*b* with respect to stone 29*a*. The thickness of the paper sections can be chosen in the range of from 0.005 to 0.050 inches. The depth of the adhesive and the thickness of the paper sections is taken into consideration when sizing the walls 45*a*, 45*b* of the base 15 in order for the finished size of the slot 33 opening to be as desired.

A pair of TEFLON pads 47 are glued or otherwise attached to the inside faces of the housing wall forming the slot. These pads are each about 0.001 to 0.015 inches thick. Again, there is intended to be sufficient flexure in the walls 45*a*, 45*b* in the region of the side sharpening paper sections 25*b*, 27*b* to allow these members to contact the sides of the skate blade 11 under finger placed on the housing base 15.

Figure 7:
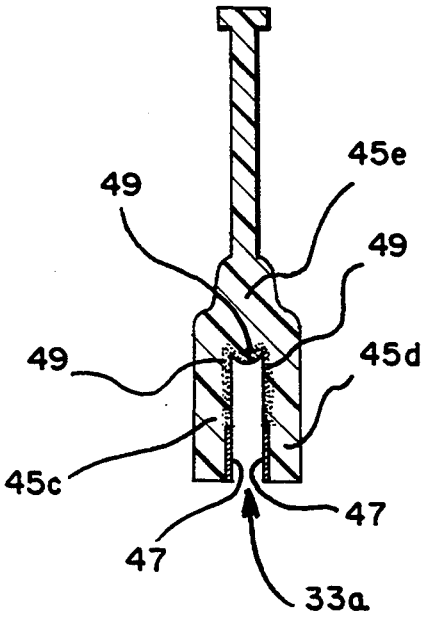
FIG. 7 is an end view of a third alternate embodiment of the tool of FIG. 4 which includes a housing formed to the contours of the three sharpening surfaces and the guide slot. This housing material in the region of the three sharpening surfaces being impregnated with honing grit to a selected depth and having a layer of friction reducing material lining the entrance walls of the guide slot.

An even further alternate embodiment is shown in FIG. 7. This constitutes a modification of the tool shown in FIG. 6. The sharpening pads 25*b*, 27*b* and 29*b* are replaced by a grit impregnated region of the molded base 15 walls 45*c*, 45*d* and shoulder 45*e* regions. This grit loading of the molded plastic creates respective side and hollow sharpening surfaces. Again TEFLON pads 47 are mounted to the entrance wall regions of the slot 33*a*.

In the embodiment of FIG. 6, the sharpening action of the grit paper sections 25*b*, 27*b*, 29*b* stops when the reasonably thin layer of grit is worn off the paper. In this way the tolerances of the sharpening dimensions and angles of the tool are maintained. The tool becomes worn out and is disposed of when the grit depth of from 0.002 inches to 0.030 inches is worn off the paper sections 25*b*, 27*b*, 29*b*. This provides a wear indicator to the operator.

In the embodiment of the grit impregnated region 49, wear indication can be achieved by dying the grit layers at various depths whereby the operator will observe a color change when a wear of from 0.002 to 0.030 inches is achieved in the sharpening surfaces of the tool shown in FIG. 7.

Many changes can be made in the above-described invention without departing from the intent and scope thereof. It is thereby intended that the above description be read in the illustrative sense and not in the limiting sense. Substitutions can be made in the depth and dimensions stated above and for the wear and other tolerances rendered thereby.

What is claimed is:

1. A disposable hand-held ice skate blade sharpening tool comprising:

a housing;

a handle extending away from said housing and connected thereto;

a plurality of sharpening surfaces positioned within said housing for simultaneously dressing each of the hollow bottom and both sides of an ice skate blade in contact therewith during a single stroke of said ice skate blade over said plural sharpening surfaces; and wherein said housing includes sharpening pressure control means comprising a pair of opposing walls, each said wall in contact with and supporting a respective one of a pair of opposed side sharpening surfaces which simultaneously dress both sides of said skate blade, said housing opposing walls being deformable under finger pressure for moving said pair of opposed blade side sharpening surfaces into closer contact with said skate blade sides.

2. The disposable tool of claim 1 wherein said housing is of pliable material and wherein said handle is of pliable material, the connection of said handle to said housing being to promote an even distribution of sharpening pressures along the length of said housing.

3. The disposable tool of claim 2 wherein said housing includes a guide slot into which said skate blade to be sharpened is inserted; and wherein said plurality of sharpening surfaces includes a first and second juxtaposed planer sharpening surface along opposite faces of said guide slot, said first and second juxtaposed planer sharpening surfaces being in contact with said skate blade sides when said skate blade is in position within said guide slot, and a convex arched sharpening surface positioned between said first and second juxtaposed planer sharpening surfaces and generally facing normal to the planer of said juxtaposed planer surfaces, said convex arched sharpening surface being in contact with said skate blade hollow when said skate blade is in position within said guide slot.

4. The disposable tool of claim 2 wherein said handle extends along the entire length of the elongate housing and is connected to said housing along said housing entire length; and also including a top flange connected to said handle blade at its free edge and extending perpendicular to said blade edge.

5. A disposable hand-held ice skate blade sharpening tool comprising:

an elongate housing;

a blade shaped handle extending away from said housing and connected thereto;

a plurality of sharpening surfaces positioned within said housing for simultaneously dressing the hollow and both sides of an ice skate blade brought in contact therewith;

wherein said housing is of pliable material and wherein said handle is of pliable material, the connection of said handle to said housing being to promote an even distribution of sharpening pressures along the length of said housing;

wherein said housing includes a guide slot into which said skate blade to be sharpened is inserted;

wherein said plurality of sharpening surfaces includes a first and second juxtaposed planer sharpening surface along opposite faces of said guide slot, said first and second juxtaposed planer sharpening surfaces being in contact with said skate blade sides when said skate blade is in position within said guide slot, and a convex arched sharpening surface positioned between said first and second juxtaposed planer sharpening surfaces and generally facing normal to the planer of said juxtaposed planer surfaces, said convex arched sharpening surface being in contact with said skate blade hollow when said skate blade is in position within said guide slot;

wherein said handle extends along the entire length of the elongate housing and is connected to said housing along said housing entire length;

a top flange connected to said handle blade at its free edge and extending perpendicular to said blade edge; and wherein said housing includes a pair of opposing walls in contact with and supporting said sharpening surfaces which simultaneously dress both sides of said skate blade, said housing opposing walls being deformable under finger pressure for moving said simultaneous dressing sharpening surfaces into closer contact with said skate blade sides.

6. The disposable tool of claim 5 wherein said blade handle is deformable under lateral pressure thereby reducing the effect of lateral pressure being otherwise transmitted to said sharpening surfaces.

7. The disposable tool of claim 6 wherein said housing includes an alignment slot for receiving said skate blade for sharpening, wherein said sharpening surfaces operate to sharpen said skate blade hollow edge and said skate blade sides.

8. The disposable tool of claim 7 wherein said sharpening surfaces include:

a first planer sharpening surface positioned on a first wall of said alignment slot;

a second planer sharpening surface positioned on the opposing wall of said alignment slot in juxtaposed relation to said first sharpening surface; and a convex arched sharpening surface positioned between said juxtaposed planer sharpening surfaces and at the bottom of said alignment slot to face in a direction perpendicular to the faces of said first and second planer sharpening surfaces.

9. The disposable tool of claim 8 wherein said first and second planer surfaces are implemented by grit paper fastened to said alignment slot walls.

10. The disposable tool of claim 8 wherein said first and second planer surfaces are implemented by the grit impregnation of the walls of the alignment slot.

11. The disposable tool of claim 8 wherein said first and second planer surfaces are implemented by elongate rectangular honing stones received within the base of said housing whereof the respective open faces thereof form said alignment slot walls.

12. The disposable tool of claim 8 wherein said convex arched sharpening surface is implemented by a structure chosen from the class of: a convex arched surface of said base forming said slot surface and impregnated with grit particles, a convex arched surface of said base forming said slot surface and covered with a sheet of grit paper, a rectangular honing stone received and held within said base and having a convex arched face positioned to be said sharpening face.

13. The disposable tool of claims 8, 9, 10, 11, 12 wherein said sharpening surfaces include a wear indicator.

14. The disposable tool of claim 3 wherein said first and second planer sharpening surfaces are each implemented by a structure chosen from a class of: the surface of said base forming said slot surface impregnated with grit particles, the surface of said base forming said slot surface and covered with a sheet of grit paper, a rectangular honing stone received and held within said base and having a honing face forming the wall of said slot surface; and wherein said convex arched sharpening surface is implemented by a structure chosen from a class of: a convex arched surface of said base forming said slot surface and impregnated with grit particles, a convex arched surface of said base forming said slot surface and covered with a sheet of grit paper, a rectangular honing stone received and held within said base and having a convex arched face positioned to be said sharpening face.

15. The disposable tool of claim 14 wherein each of said sharpening surfaces incorporates wear indicator structure.

16. A disposable hand-held ice skate blade sharpening tool comprising:

an elongate housing;

a blade shaped handle extending away from said housing and connected thereto;

a plurality of sharpening surfaces positioned within said housing for simultaneously dressing the hollow and both sides of an ice skate blade brought in contact therewith;

wherein said housing is of pliable material and wherein said handle is of pliable material, the connection of said handle to said housing being to promote an even distribution of sharpening pressures along the length of said housing;

wherein said housing includes a guide slot into which said skate blade to be sharpened is inserted;

wherein said plurality of sharpening surfaces includes a first and second juxtaposed planer sharpening surface along opposite faces of said guide slot, said first and second juxtaposed planer sharpening surfaces being in contact with said skate blade sides when said skate blade is in position within said guide slot, and a convex arched sharpening surface positioned between said first and second juxtaposed planer sharpening surfaces and generally facing normal to the planer of said juxtaposed planer surfaces, said convex arched sharpening surface being in contact with said skate blade hollow when said skate blade is in position within said guide slot;

wherein said first and second planer sharpening surfaces are each implemented by a structure chosen from a class of: the surface of said base forming said slot surface impregnated with grit particles, the surface of said base forming said slot surface and covered with a sheet of grit paper, a rectangular honing stone received and held within said base and having a honing face forming the wall of said slot surface;

wherein said convex arched sharpening surface is implemented by a structure chosen from a class of: a convex arched surface of said base forming said slot surface and impregnated with grit particles, a convex arched surface of said base forming said slot surface and covered with a sheet of grit paper, a rectangular honing stone received and held within said base and having a convex arched face positioned to be said sharpening face; and friction reducing guide members at the entrance region of said slot walls, said friction reducing guide members being implemented by structure chosen from the class of: plastic blocks formed into the wall of the base of said housing, friction reducing pads mounted to the faces of said slot.

* * * * *